US006945426B2

(12) United States Patent
Gentzkow et al.

(10) Patent No.: US 6,945,426 B2
(45) Date of Patent: Sep. 20, 2005

(54) MEDICINE DISPENSING SYSTEM

(76) Inventors: Douglas K. Gentzkow, 10325 216th Ct. NE., Redmond, WA (US) 98053; Christian D. Valburg, 4209 E. Lynn St., Seattle, WA (US) 98102

( * ) Notice: Subject to any disclaimer, the term of this patent is extended or adjusted under 35 U.S.C. 154(b) by 106 days.

(21) Appl. No.: 10/205,271

(22) Filed: Jul. 23, 2002

(65) Prior Publication Data

US 2004/0016774 A1 Jan. 29, 2004

(51) Int. Cl.[7] ..... B65D 25/22
(52) U.S. Cl. ..... 220/751
(58) Field of Search ..... 224/602, 604, 224/219, 222; 63/3; 424/456, 451, 439; 220/751; 426/138, 140; 222/175

(56) References Cited

U.S. PATENT DOCUMENTS

| | | | | | |
|---|---|---|---|---|---|
| 2,342,372 | A | | 2/1944 | Scherer | 221/60 |
| 3,680,751 | A | | 8/1972 | Brook | 224/28 B |
| 4,023,712 | A | | 5/1977 | Babiak et al. | 222/175 |
| 4,078,660 | A | | 3/1978 | Lerro | 206/530 |
| 4,733,807 | A | * | 3/1988 | Porter et al. | 224/604 |
| 5,476,194 | A | | 12/1995 | Hippely et al. | 222/192 |
| 5,939,097 | A | * | 8/1999 | Fusejima et al. | 424/451 |
| 5,941,433 | A | | 8/1999 | Wilcher | 224/191 |
| 6,056,729 | A | | 5/2000 | Yu et al. | 604/289 |
| 6,155,409 | A | | 12/2000 | Hettinger | 206/38 |

* cited by examiner

*Primary Examiner*—Stephen Castellano

(57) ABSTRACT

A medicine dispensing system for providing immediate oral dispensing of medicine in the event of an emergency. The medicine dispensing system includes a lanyard and a container having a volume of medicine in a liquid or gel state within. The container is constructed of a casing defining an interior reservoir. The casing is constructed of a waterproof material that is capable of being ruptured between the teeth of the user thereby dispensing the medicine from within the casing.

11 Claims, 8 Drawing Sheets

MEDICINE DISPENSING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to medicine applicator devices and more specifically it relates to a medicine dispensing system for providing immediate oral dispensing of medicine in the event of an emergency.

2. Description of the Related Art

Medicine pills and capsules have been in use for years. A conventional pill is comprised of a hardened structure that is stored within a pill container. Capsules are comprised of an encapsulated fluid or particulate material which are also stored within a container. With both pills and capsules are typically swallowed by the user after being removed from their respective storage container.

The main problem with conventional medicine delivery devices currently available is that they require the user to perform a series of steps prior to delivering the medicine to the user. Conventional medicine delivery devices require the user to (i) locate the medicine container, (ii) remove the cover of the medicine container, (iii) locate a water or other fluid source to drink in conjunction with swallowing the medicine, (iv) swallowing the medicine, and (v) reattaching the cover to the medicine container to prevent spillage of the contents. Medicine containers are known for being difficult to open, even containers that are designed for over the counter medicine such as but not limited to aspirin. With time being of the essence in some emergencies such as a heart attack, it is important to access and deliver the medication in an efficient amount of time which conventional medicine delivery devices do not allow for.

Examples of patented devices which may be related to the present invention include U.S. Pat. No. 5,476,194 to Hippely et al.; U.S. Pat. No. 6,155,409 to Hettinger; U.S. Pat. No. 5,941,433 to Wilcher; U.S. Pat. No. 3,680,751 to Ten Brook; U.S. Pat. No. 2,342,372 to Scherer; U.S. Pat. No. 4,023,712 to Babiak et al.; U.S. Pat. No. 4,078,660 to Lerro; and U.S. Pat. No. 6,056,729 to Yu et al.

While these devices may be suitable for the particular purpose to which they address, they are not as suitable for providing immediate oral dispensing of medicine in the event of an emergency. Conventional medicine applicator devices and systems require the individual to perform a number of steps prior to actually receiving the medication.

In these respects, the medicine dispensing system according to the present invention substantially departs from the conventional concepts and designs of the prior art, and in so doing provides an apparatus primarily developed for the purpose of providing immediate oral dispensing of medicine in the event of an emergency.

BRIEF SUMMARY OF THE INVENTION

In view of the foregoing disadvantages inherent in the known types of medicine now present in the prior art, the present invention provides a new medicine dispensing system construction wherein the same can be utilized for providing immediate oral dispensing of medicine in the event of an emergency.

The general purpose of the present invention, which will be described subsequently in greater detail, is to provide a new medicine dispensing system that has many of the advantages of the medicine mentioned heretofore and many novel features that result in a new medicine dispensing system which is not anticipated, rendered obvious, suggested, or even implied by any of the prior art medicine delivery devices, either alone or in any combination thereof.

To attain this, the present invention generally comprises a lanyard and a container having a volume of medicine in a liquid or gel state within. The container is constructed of a casing defining an interior reservoir. The casing is constructed of a waterproof material that is capable of being ruptured between the teeth of the user thereby dispensing the medicine from within the casing.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a medicine dispensing system that will overcome the shortcomings of the prior art devices.

A second object is to provide a medicine dispensing system for providing immediate oral dispensing of medicine in the event of an emergency.

Another object is to provide a medicine dispensing system that allows for quick access and delivery of medicine to an individual.

An additional object is to provide a medicine dispensing system that remains with the user in an easy to access location at all times during the day and night.

A further object is to provide a medicine dispensing system that provides an expedited delivery of medicine in an emergency or perceived emergency.

Another object is to provide a medicine dispensing system that may be utilized to dispense various types of medicine such as but not limited to aspirin.

A further object is to provide a medicine dispensing system that provides an uncomplicated system of self-medication.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
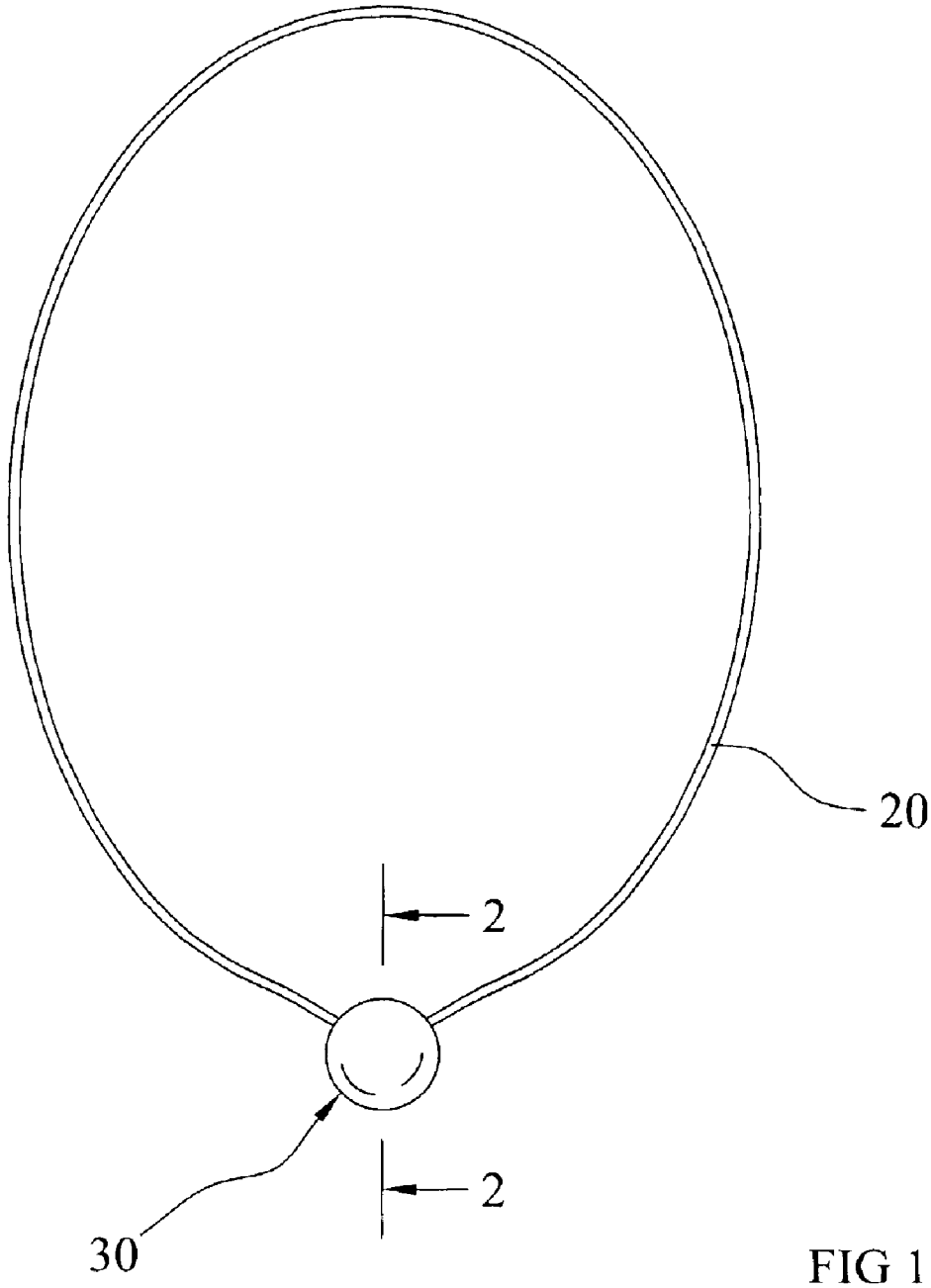
FIG. 1 is a front view of the present invention.

Turning now descriptively to the drawings, in which similar reference characters denote similar elements throughout the several views, FIGS. 1 through 8 illustrate a medicine dispensing system 10, which comprises a lanyard 20 and a container 30 having a volume of medicine 40 in a liquid or gel state within. The container 30 is constructed of a casing 32 defining an interior reservoir 34. The casing 32 is constructed of a waterproof material that is capable of being ruptured between the teeth 14 of the user thereby dispensing the medicine 40 from within the casing 32.

Figure 2:
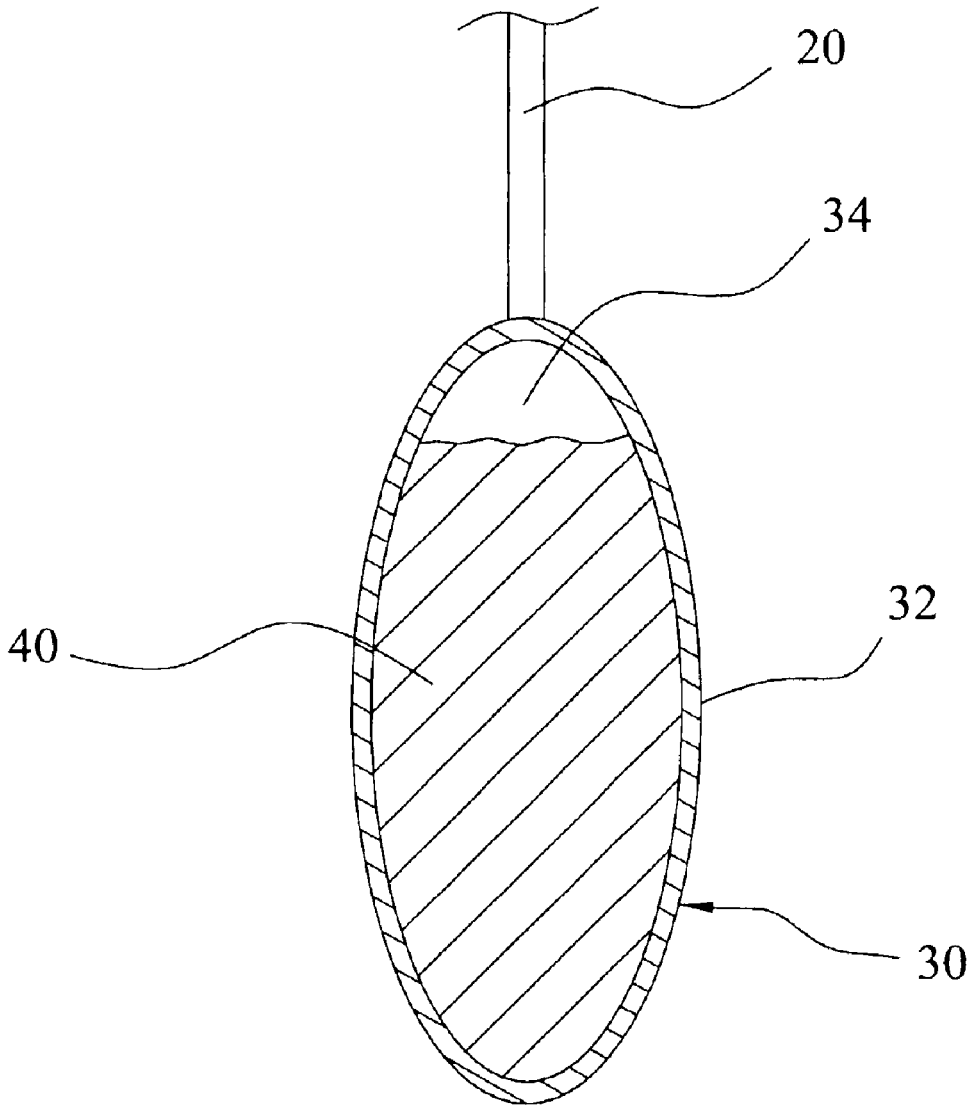
FIG. 2 is a cross sectional view taken along line 2—2 of FIG. 1.
Figure 3:
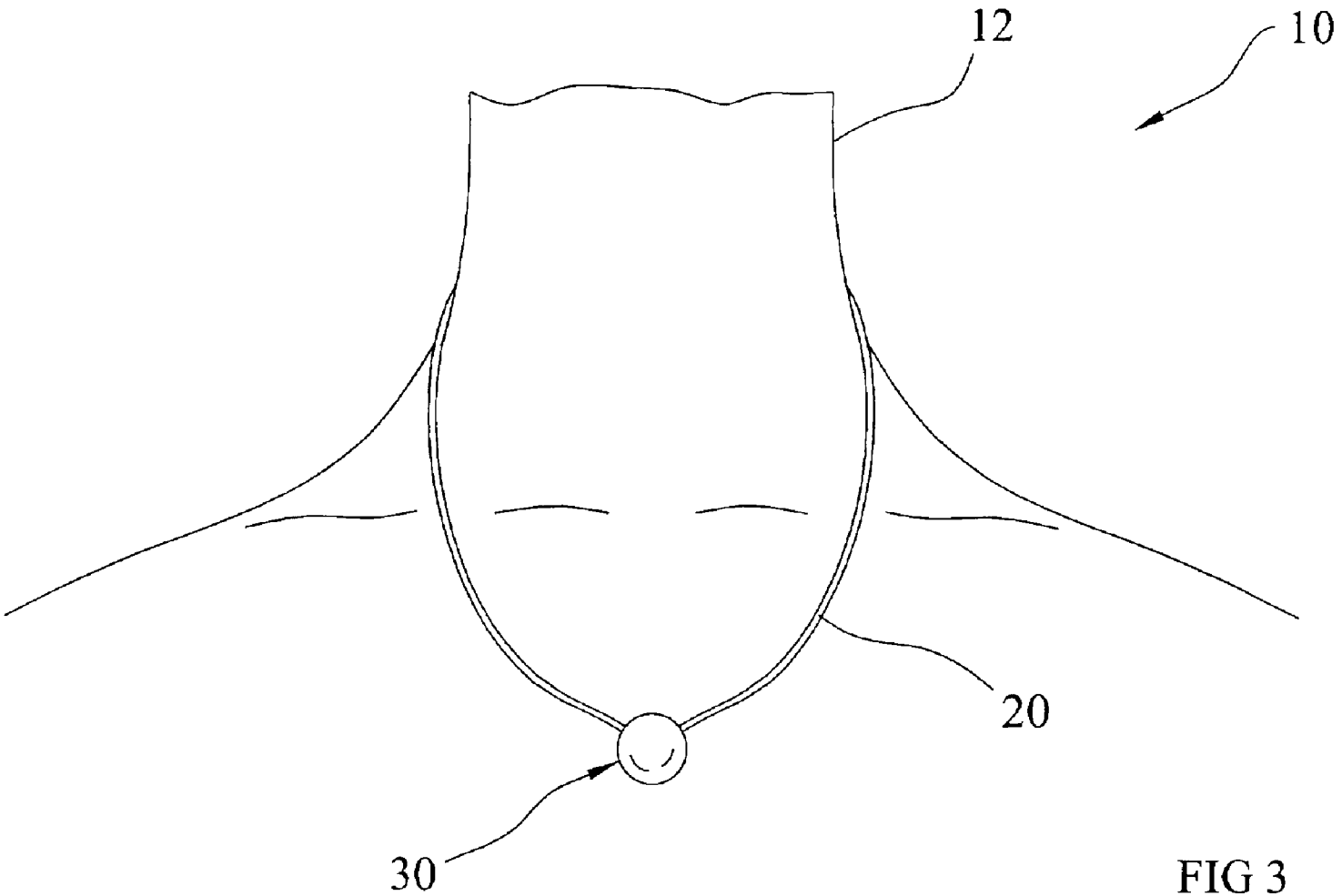
FIG. 3 is a front view of the present invention attached about the neck of an individual.

As shown in FIG. 2 of the drawings, the container 30 is comprised of a casing 32 defining an interior reservoir 34 sufficient to hold a desired volume of medicine 40. The casing 32 is preferably comprised of a non-permeable and edible material which are commonly utilized within the medical industry for storing liquid drugs and other related items. However, the casing 32 may be comprised of a non-permeable and non-edible material such as but not limited to plastic. The casing 32 may also be comprised of a soluble gelatin based material commonly utilized to construct capsules. The casing 32 is further comprised of a material having a strength sufficient to prevent accidental breakage during everyday activities of the user while being easily ruptured by biting between the teeth 14 of the user.

Figure 4:
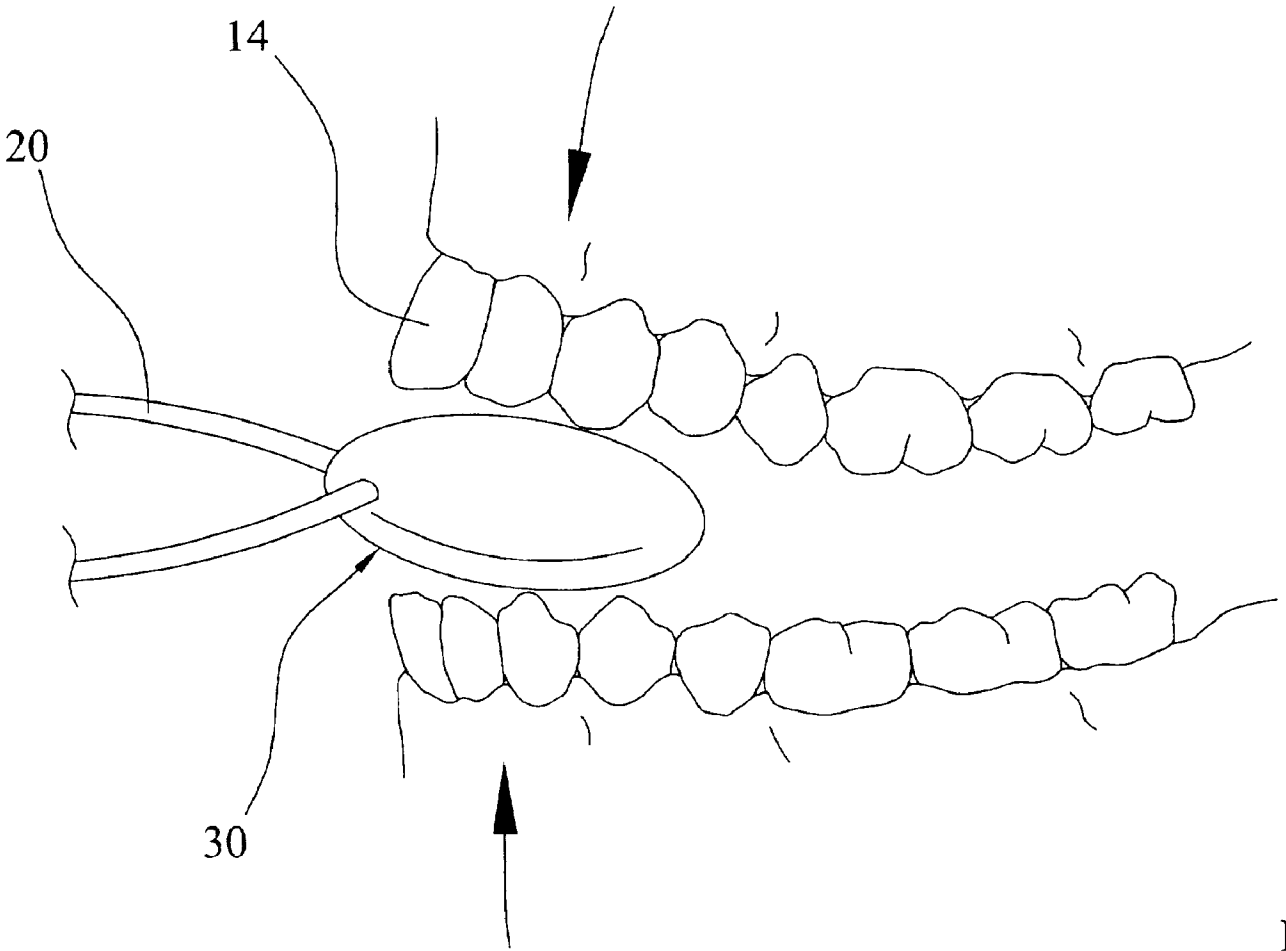
FIG. 4 is a side perspective view of the present invention positioned between the upper and lower teeth of an individual.
Figure 5:
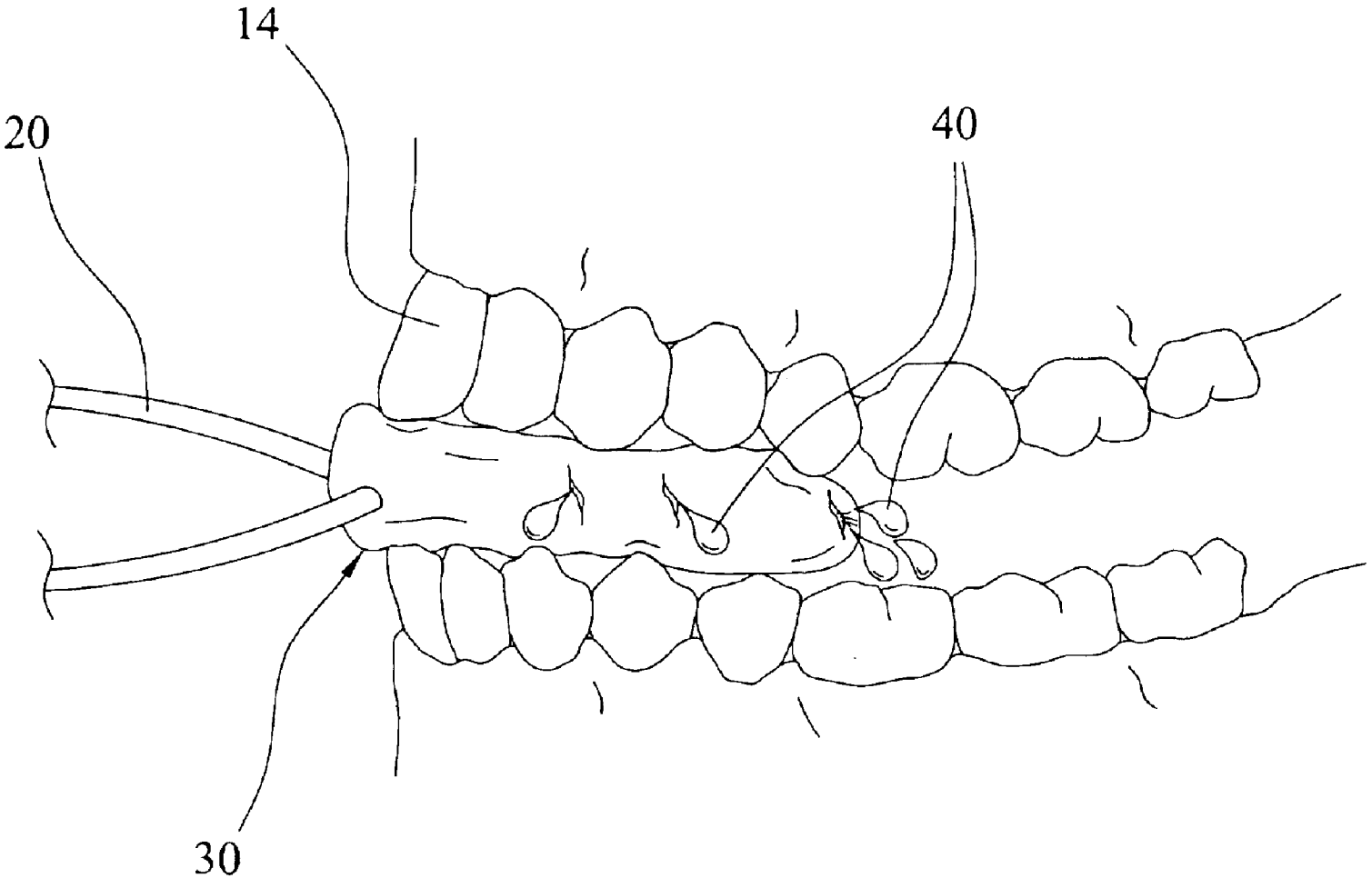
FIG. 5 is a side perspective view of the present invention positioned between the upper and lower teeth of an individual with the teeth compressing the casing which is then ruptured.
Figure 6:
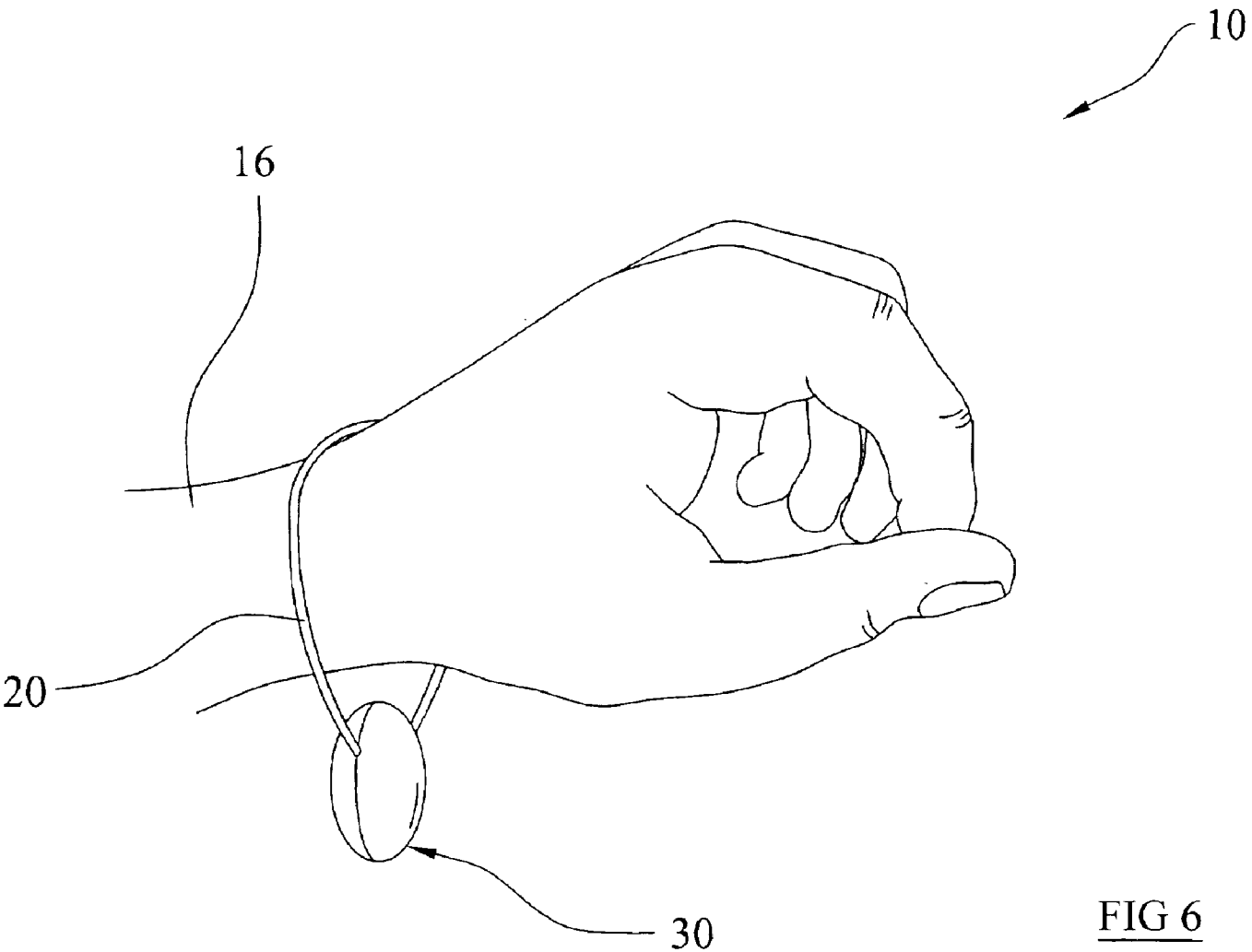
FIG. 6 is an upper perspective view of the present invention positioned about the wrist of an individual.

The casing 32 is preferably comprised of a circular front shape with a side profile having an oblong structure as best illustrated in FIGS. 1, 2 and 4 of the drawings. However, the casing 32 may have various other shapes such as but not limited to a cross shape, or a sports ball shape such as a football. Various designs and logos may also be affixed to the exterior surface of the casing 32 to identify the medicine 40 within the container 30.

The medicine 40 within the reservoir 34 of the container 30 may be comprised of a liquid or gel substance. The medicine 40 may be comprised of a liquid aspirin or other drug commonly provided to individuals for various ailments and health conditions. Manufacturing liquid or gel forms of a medicine 40 are well-known in the medical industry which are suitable for producing the medicine 40 for the present invention. It can be appreciated that the medicine 40 may be comprised of a particulate material which is dissolved within the saliva of a user when placed within the mouth, however a liquid or gel form is preferred for the ease of dispensing from the ruptured casing 32.

As shown in FIG. 1 of the drawings, a lanyard 20 is attached to the container 30. The lanyard 20 may be comprised of various materials and lengths sufficient to fit about a body part such as the neck 12 or the wrist 16. The lanyard 20 is preferably attached to opposing sides of the upper portion of the casing 32 as best illustrated in FIG. 1 of the drawings. The lanyard 20 is preferably molded within the casing 32, however various other attachment devices and systems may be utilized to secure the lanyard 20 to the casing 32. The lanyard 20 may be comprised of a solid loop structure or it may have two or more distal ends.

Figure 7:
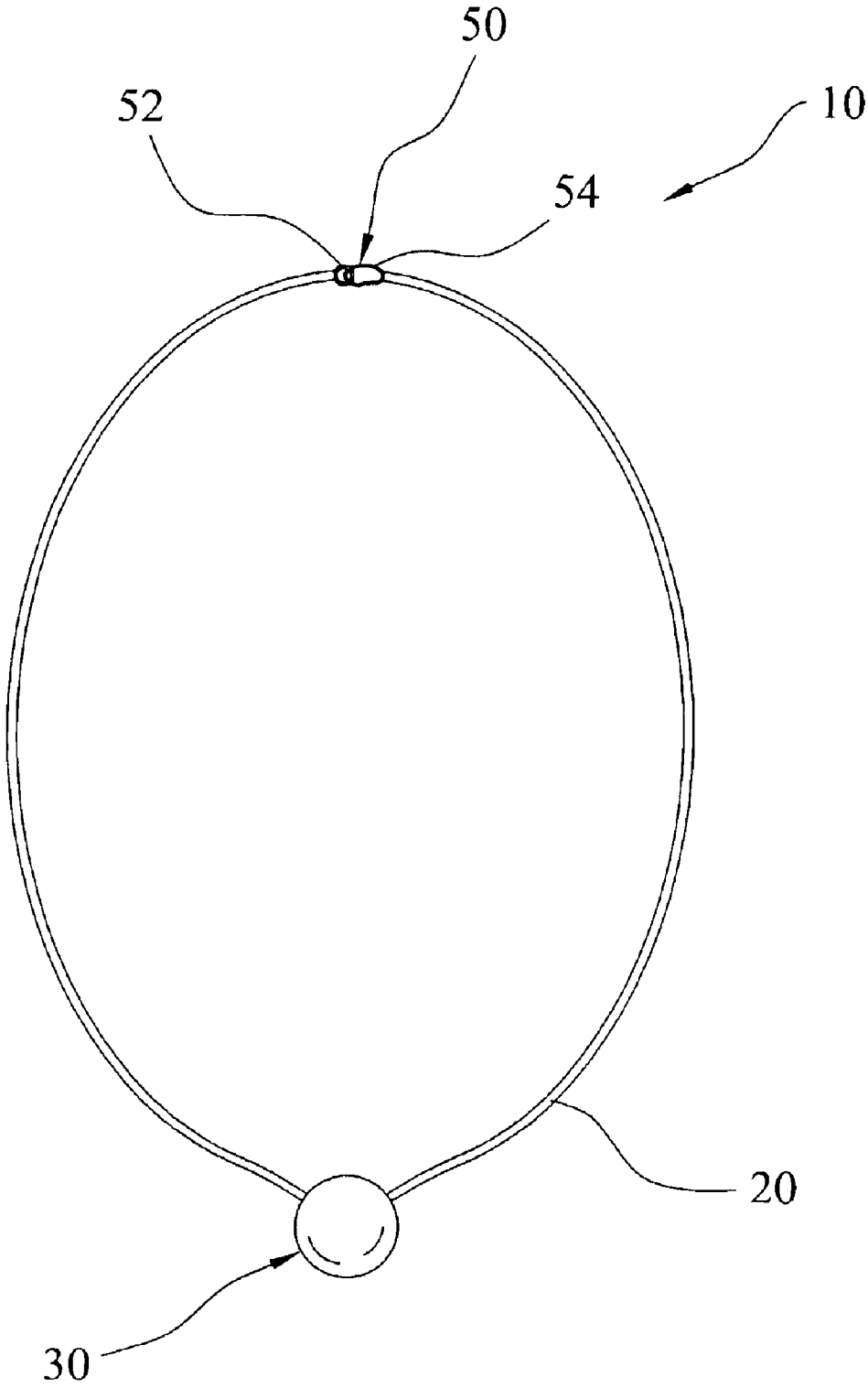
FIG. 7 is a front view of the present invention with a connector mechanism within the lanyard.
Figure 8:
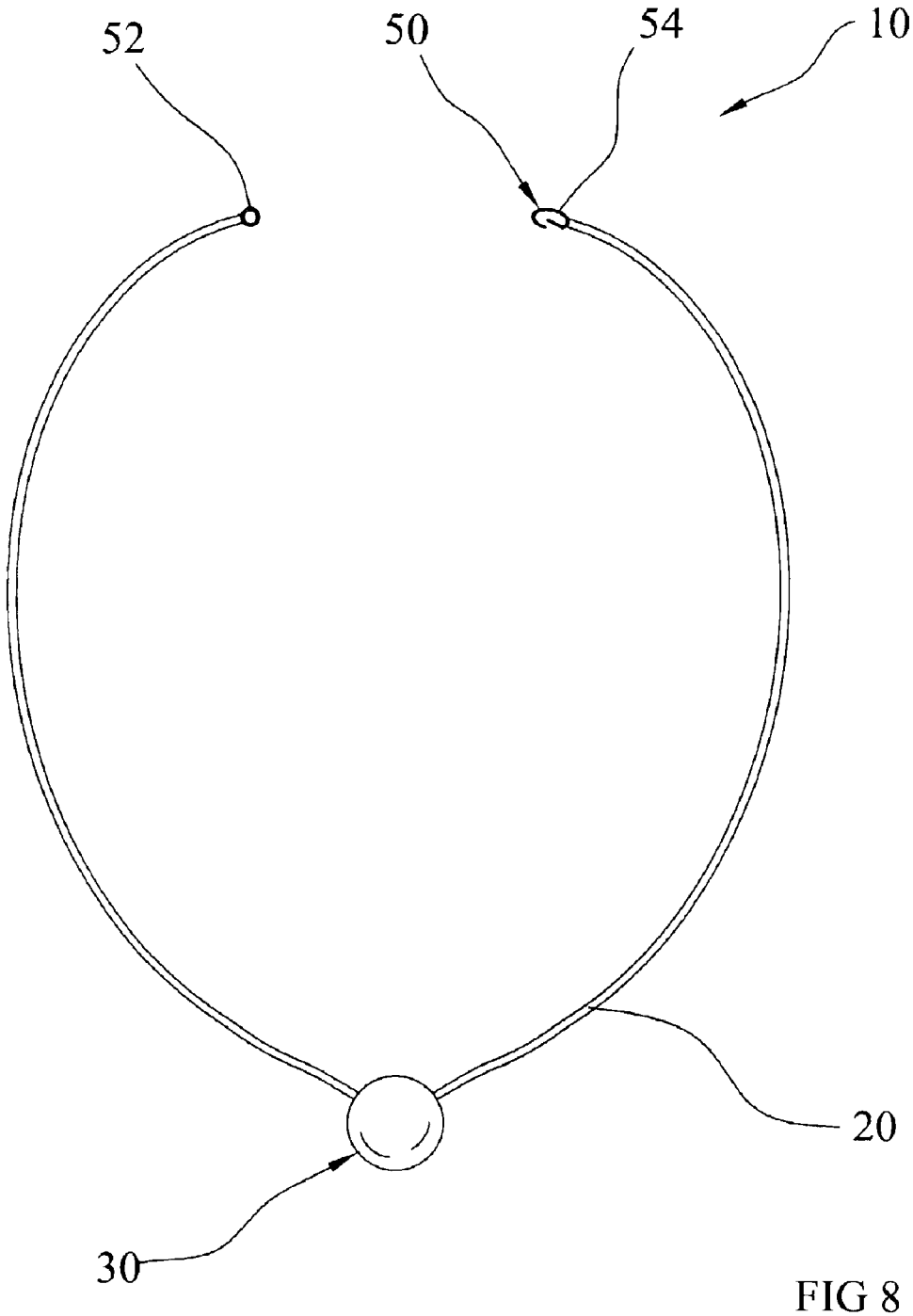
FIG. 8 is a front view of the present invention with the connector mechanism loosened.

FIGS. 7 and 8 illustrate a connector mechanism 50 positioned within the lanyard 20 for allowing securing and removal from about a user. The connector mechanism 50 may be comprised of various connector devices utilized for securing elongated objects such as necklaces and the like. FIGS. 7 and 8 illustrate the connector mechanism 50 being comprised of a loop member 52 attached to a distal end of the lanyard 20 with a hook member 54 attached to the opposing distal end of the lanyard 20 for selective interconnection thereof.

In use, the user positions the lanyard 20 about their neck 12, wrist 16 or other convenient location which may be readily accessed. When the user feels a medical emergency exists which requires the medicine 40 within the container 30, the user positions the container 30 between their upper and lower teeth 14 as shown in FIG. 4 of the drawings. The user then bites upon the container 30 until the casing 32 is ruptured thereby dispensing the medicine 40 within the container 30 into the mouth of the user. The user then swallows the medicine 40. After all of the medicine 40 has been removed from the container 30, the user then discards the lanyard 20 and the attached container 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A medicine dispensing system, comprising:

a lanyard;

a container attached to said lanyard;

wherein said container forms a solid sealed structure;

wherein said container is comprised of a rupturable and waterproof material;

wherein said container is comprised of a gelatin material, that forms a sealed reservoir; and a volume of medicine sealed within said reservoir, wherein said medicine is within a liquid state or gel state.

2. The medicine dispensing system of claim 1, wherein said container has a circular shape.

3. The medicine dispensing system of claim 1, wherein said container has an oblong shaped side shape.

4. The medicine dispensing system of claim 1, wherein said lanyard is attached to an upper portion of said container.

5. The medicine dispensing system of claim 4, wherein said lanyard has two opposing ends attached to opposing upper side sections of said container.

6. A medicine dispensing system, comprising:

a lanyard having a first end and a second end;

a connector mechanism attached to said first end and said second end of said lanyard;

a container attached to said lanyard;

wherein said container forms a solid sealed structure;

wherein said container is comprised of a rupturable and waterproof material;

wherein said container is comprised of a gelatin material that forms a sealed reservoir; and a volume of medicine sealed within said reservoir, wherein said medicine is within a liquid state or gel state.

7. The medicine dispensing system of claim 6, wherein said container has a circular shape.

8. The medicine dispensing system of claim 6, wherein said connector mechanism is comprised of a loop member attached to said first end of said lanyard and a hook member attached to said second end of said lanyard.

9. The medicine dispensing system of claim 6, wherein said lanyard is attached to an upper portion of said container.

10. The medicine dispensing system of claim 9, wherein said lanyard has two opposing ends attached to opposing upper side sections of said container.

11. A medicine dispensing system, comprising:

a lanyard having a first end and a second end;

a connector mechanism attached to said first end and said second end of said lanyard, wherein said connector mechanism is comprised of a loop member attached to said first end of said lanyard and a hook member attached to said second end of said lanyard;

a container attached to said lanyard, wherein said container has a circular front shape and wherein said container has an oblong side shape, wherein said lanyard is attached to an upper portion of said container and wherein said lanyard has two opposing ends attached to opposing upper side sections of said container;

wherein said container forms a solid sealed structure;

wherein said container is comprised of a rupturable and waterproof material;

wherein said container is comprised of a gelatin material that forms a sealed reservoir; and a volume of medicine sealed within said reservoir, wherein said medicine is within a liquid state or gel state.

* * * * *